United States Patent [19]

Martin et al.

[11] 3,953,818

[45] Apr. 27, 1976

[54] EXTERNALLY BUSSED, ENCAPSULATED CURRENT LIMITING FUSE FOR PAD MOUNTED TRANSFORMERS

[75] Inventors: Vance B. Martin, Charlotte, N.C.; George D. Allen, Centralia, Mo.; Harold D. Haubein, Centralia, Mo.; Melvin B. Goe, Jr., Centralia, Mo.; Kenneth A. Toeniskoetter, Washington, Mo.

[73] Assignee: A. B. Chance Company, Centralia, Mo.

[22] Filed: Mar. 28, 1975

[21] Appl. No.: 563,161

[52] U.S. Cl. ..... 337/191; 317/15; 339/28

[51] Int. Cl.[2] ..... H01H 85/22

[58] Field of Search ..... 317/15; 337/191, 192, 337/193; 339/28, 29, 19, 222

[56] References Cited

UNITED STATES PATENTS

| | | | |
|---|---|---|---|
| 3,014,158 | 12/1961 | Nelson et al. | 317/15 |
| 3,292,048 | 12/1966 | Swoish et al. | 317/15 |
| 3,435,291 | 3/1969 | Paulus | 317/15 |
| 3,450,945 | 6/1969 | Wurdack | 317/15 |
| 3,701,926 | 10/1972 | Risk | 317/15 |

*Primary Examiner*—Harold Broome
*Attorney, Agent, or Firm*—Schmidt, Johnson, Hovey & Williams

[57] ABSTRACT

A rigid, unitary, externally mounted combination bus bar and current interrupter especially adapted for protecting pad-mounted transformers from the effects of fault currents is provided which precludes catastrophic transformer failures by ensuring that all energized parts within the transformer tank are on the protected load side of the current interrupter while also providing an external, insulated bus bar having strategically spaced, line-connecting, loop feed bushings which preclude arcing-over therebetween and permit the transformer to be safely system-installed according to established practices with preexisting feeder lines. The assembly preferably includes a rigid, encapsulated bus bar carrying a central conductor which electrically connects the spaced terminator-receiving bushings thereon in order to define an external electrical feed loop, with an integrally attached, oil-submersible high-range current limiting fuse extending from the bar and into the tank of the protected transformer. This construction permits safe, desirable double-fusing of the transformer with a series-related internal low-range expulsion-type fuse in order to enhance overall system coordination and ensure that only the easily replaceable expulsion fuse operates in the case of normally encountered low-range faults.

19 Claims, 6 Drawing Figures

EXTERNALLY BUSSED, ENCAPSULATED CURRENT LIMITING FUSE FOR PAD MOUNTED TRANSFORMERS

This invention relates to protective apparatus especially suited for use with pad-mounted transformers and of the type including an external feed loop bus bar with a current interrupter for protecting the transformer against the potentially disasterous effects of fault currents. More particularly, it is concerned with such protective apparatus wherein a rigid, insulated, externally mounted bus bar is provided in conjunction with a current interrupting means (e.g., a current limiting fuse) such that all energized parts within the transformer tank are on the protected load side of the fuse in order to minimize the possibility of internal faults-to-ground which can lead to transformer explosions or the like.

In recent years electrical utilities have made increasing use of underground electrical transmission and distribution lines, especially in residential service. This in turn has led to the use of so-called pad-mounted transformers which are generally situated at or near grade on a concrete footing and electrically interconnected with the underground distribution lines by means of short feeders which are arranged according to established standards and specifications. In addition, these pad-mounted transformers are normally provided with an internal bussing arrangement in order to provide a loop electrical feed for installing a series of such transformers within the overall distribution system.

Increasingly heavy demands for electrical power have also caused utilities to uprate their URD transmission and distribution systems in order to handle heavier current and voltage loads. As a consequence, the fault currents normally experienced with the uprated URD systems have risen correspondingly to a point where conventional protective equipment has in some instances been found to be inadequate. In certain extreme cases, high magnitude faults have been known to cause transformer explosions with attendant tank rupture and other dangerous effects. Therefore, in order to meet user demand while maintaining safe operating conditions, utilities have been searching for ways to adequately protect URD equipment such as pad-mounted transformers from catastrophic fault-induced failures.

Conventional expulsion-type fuses have been used for a number of years for protecting transformers of all types. In general, these fuses are situated within the transformer and submerged below the oil level therein. When a fault is experienced, these fuses actuate in the well-known manner in order to clear the fault and protect the transformer. However, the higher current and voltage ratings now being conventionally handled have made it difficult to provide a simple expulsion fuse capable of clearing many of the high magnitude fault currents which have been experienced in practice. For example, at 7.5 KV expulsion fuses can safely clear faults up to about 4,000 amps in magnitude, while in practice faults in excess of this figure have been experienced. Therefore, it has been determined that simple expulsion fuses alone are not a sufficient answer in protecting transformers against all present day faults.

It has also been suggested to employ current limiting fuses as protective devices for transformers. Such transformer-applied fuses have generally been of the full-range variety which are constructed to actuate upon experiencing faults of widely varying levels. While such current limiting fuses have the capability of clearing faults of much higher magnitudes than simple expulsion fuses, their expense and the difficulty in replacing the same has militated against their widespread use with pad-mounted transformers or the like.

Another significant problem encountered with conventional pad-mounted transformers stems from the bussing arrangement used in conjunction therewith. That is, it is a common practice to provide a flexible metallic, strap-like bus situated within the transformer tank for electrically connecting the respective source and load lines attached to bushings on the external face of the pad-mounted transformer. This bussing arrangement is conventionally provided in order to permit the transformer to be system-installed in series with other transformers and to permit selective isolation of a transformer in the event of a fault. By virtue of the fact that the internal bus is of necessity connected within the transformer tank on the source side of the fuse protection provided for the transformer, it will be appreciated that even upon actuation of the protective fuse or fuses, the internal bus remains energized. This condition can lead to dangerous faults-to-ground between the energized bus and the metallic tank walls even after actuation of the internal protective fuses, especially since the flexible busses characteristically move under the influence of electromechanical forces developed during fault situations which can lead to a direct short if contact is made between the bus and tank wall. Also, since many transformers are of the "dead front" type with grounded tank walls, such bus-to-wall contact can present hazards of electrocution in the relatively rare situations where tank ground is lost. Finally, should the transformer loose oil through a leaky bushing or the like, the exposed, energized bus can cause a fault-to-ground because of the presence of ionizable gases above the oil level. This also can lead to potentially violent transformer failure.

Flexible internal conductive busses are also troublesome when it becomes necessary to replace the external transformer bushings. For example, the lineman must first pull the ends of the bus out of the transformer tank itself through the bushing openings therein and then connect replacement bushings thereto. When the new bushing is installed within the corresponding aperture therefor, the flexible strap-like bus is of course pushed back into the transformer tank. A careless lineman can in some instances cause the flexible bus to come into continuing contact with the tank wall, since he cannot see the position of the bus within the tank. This of course establishes a direct line-to-ground fault because of the direct current path defined by the bus and grounded tank wall.

It is therefore the most important object of the present invention to provide protective apparatus for pad-mounted transformers and the like which lessens the amount of energized equipment within the transformer tank and ensures that all internal energized equipment is on the protected load side of a current interrupter in order to minimize the possibility of faults-to-ground between such energized equipment and the transformer tank walls, while moreover providing a bussing arrangement permitting the transformer to be system-installed in series with other transformers according to well-established practices using preexisting, standardized feeders.

Another object of the present invention is to provide protective apparatus of the type described including external, insulated bussing structure with current interrupting means electrically and mechanically connected thereto and extending into the transformer tank; the load side of the current interrupting means is electrically connected with the transformer primary in the normal manner so that all energized equipment within the transformer tank is protected by the current interrupting means, while the rigid bus provides a safe, insulated electrical feed loop with line-connecting bushings thereon which are strategically spaced to preclude flashover therebetween and permit system-installation of the protected transformer.

A still further object of the invention is to provide unitary external bus bar-current interrupter apparatus which includes a high-range, encapsulated, oil submersible current limiting fuse which is especially adapted to be connected in series with a conventional, internal expulsion-type fuse in order to provide adequate fault protection for the transformer and enhance overall system coordination.

Figure 5:
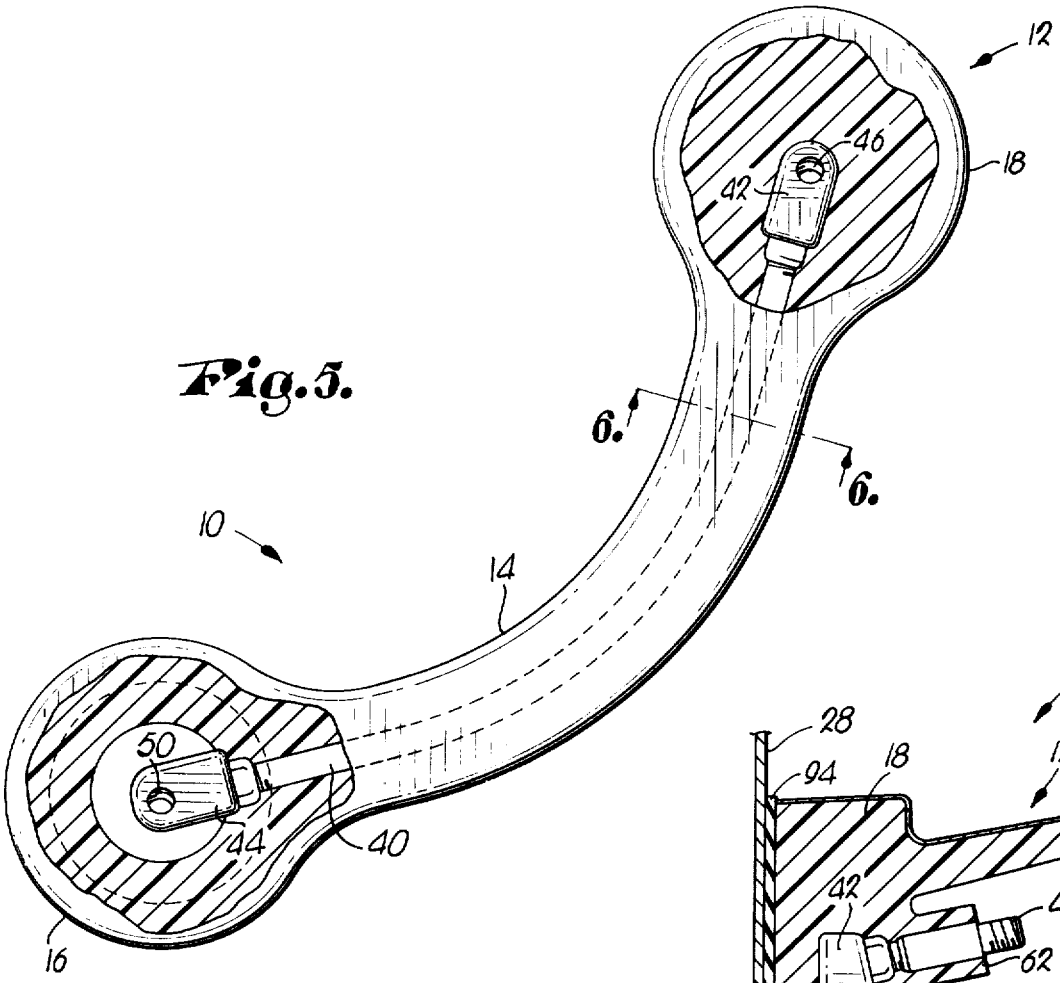
FIG. 5 is a view in partial vertical section illustrating the central bus conductor and the respective spaced, terminator-receiving bushings on the bus bar of the present invention.
Figure 6:
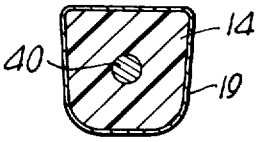
FIG. 6 is a sectional view taken along line 6—6 of FIG. 5.
Figure 4:
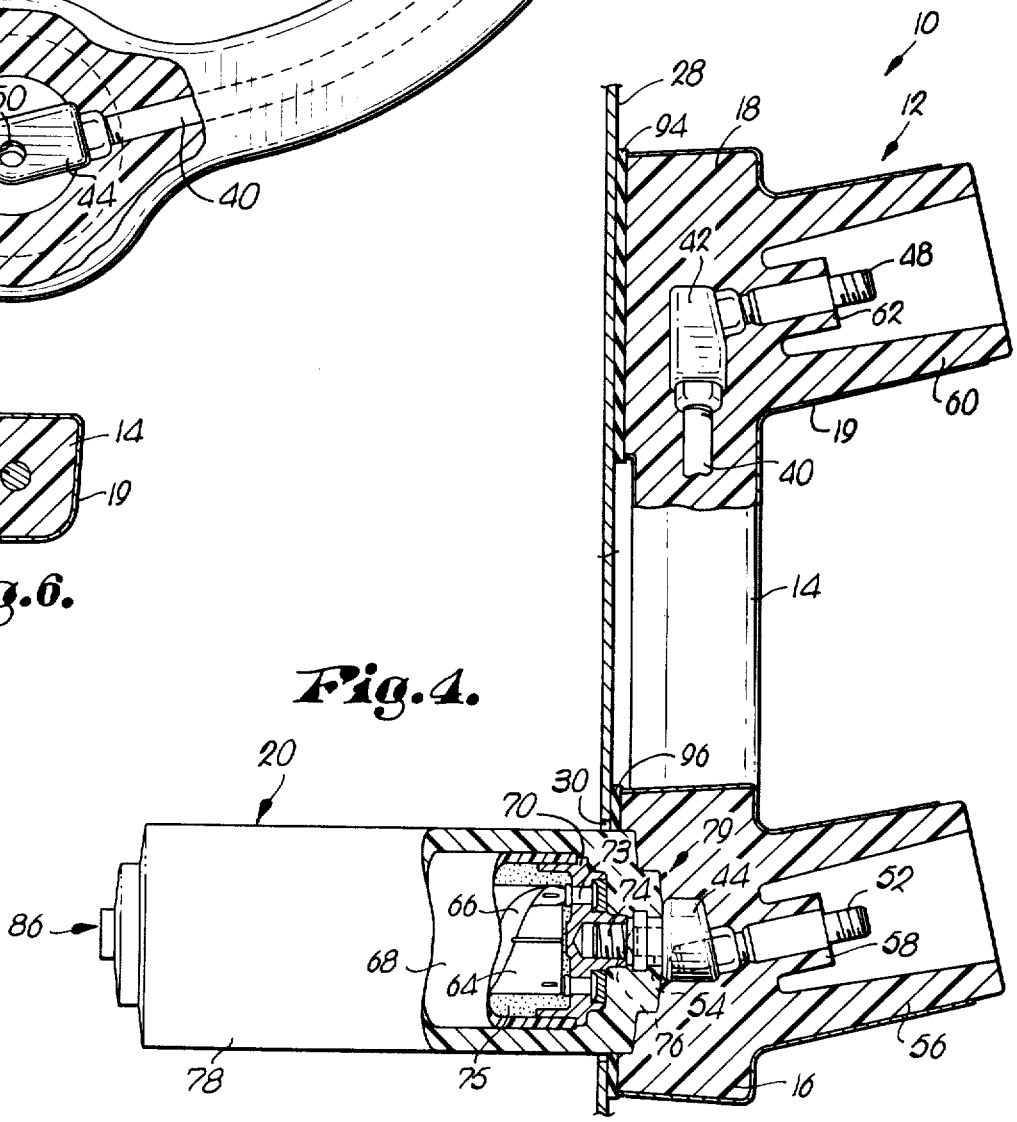
FIG. 4 is a view in partial vertical section with parts broken away for clarity of the bus bar-current limiting fuse construction of the invention, shown operatively mounted on the wall of a transformer.

A combination bus bar and current interrupter apparatus 10 is illustrated in FIGS. 4 and 5. Apparatus 10 includes a rigid, encapsulated, insulated bus bar 12 having an arcuate central shank portion 14 with a rounded source-line connecting end 16 and a spaced, similarly configured load-line connecting end 18. A current limiting fuse 20 is integrally connected to bar 12 adjacent connecting end 16 and extends generally rearwardly therefrom as best seen in FIG. 4.

Figure 1:
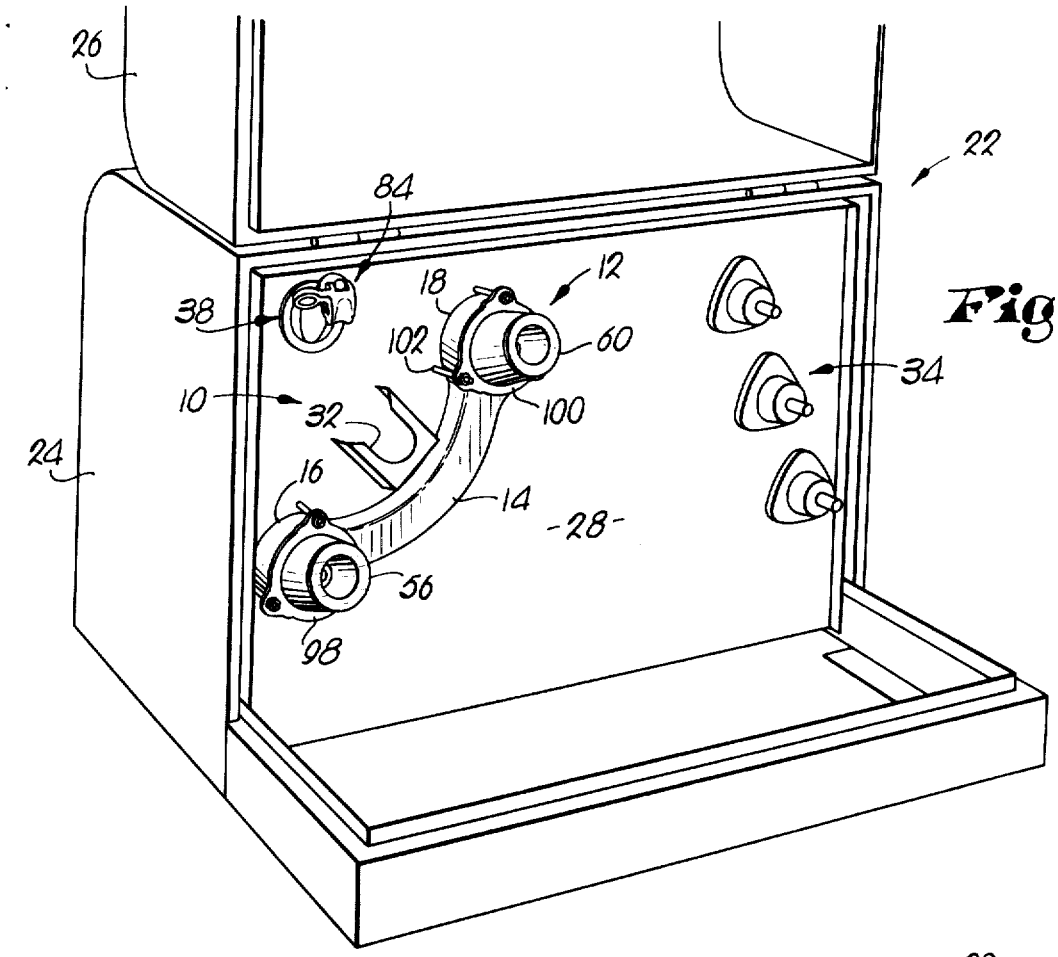
FIG. 1 is a perspective view of a transformer having the bus bar-current limiting fuse construction of the present invention operatively installed thereon.

Referring now to FIG. 1, it will be seen that apparatus 10 is especially adapted for mounting on a pad-mounted transformer 22. The latter includes an oil tank 24 housing the internal coil windings and other well-known apparatus, along with a hingedly mounted lid 26 for covering the front connection panel 28 of the transformer. Panel 28 is provided with a source line aperture 30 (see FIG. 4), a parking stand clip 32, a series of three vertically spaced service terminals 34, and an expulsion tube-receiving aperture (not shown). An elongated, combination expulsion fuse-load break assembly 38 is situated within tank 24 and extends outwardly therefrom through the appropriate aperture.

In more detail, bus bar 12 is a molded, unitary member of rigid insulative epoxy material which includes a central, curved, metallic conductor 40 situated within curved portion 14 and extending between respective line-connecting ends 16 and 18. Substantially the entire exterior surface of bus bar 12 is preferably coated with a conductive shielding material 19 for the purpose of maintaining a uniform and controlled electrical stress on the bus insulation and also as a safety feature to protect linemen working in the vicinity of the external bus. A pair of conductive metallic fittings 42 and 44 are respectively threaded onto the opposed ends of conductor 40. Fitting 42 includes a threaded aperture 46 which receives a complemental threaded stud 48. Similarly, fitting 44 is provided with a threaded aperture 50 receiving a complemental threaded stud 52. In this case however, fitting 44 also includes a rearwardly extending threaded stud 54 (FIG. 4) which is adapted for threaded connection with fuse 20, as will be explained.

Connecting end 16 includes an integral, annular cup-like bushing 56 which is obliquely oriented relative to the vertical as seen in FIG. 4. Bushing 56 also includes a central, axial sleeve portion 58 which surrounds the midportion of stud 52 in order to locate the same within the bushing. Finally, connecting end 18 also includes a similarly oriented insulative annular bushing 60 having a central sleeve-like portion 62 which surrounds and locates the corresponding stud 48 within the bushing.

Current limiting fuse 20 may be of the general type disclosed in co-owned U.S. Pat. No. 3,863,187. For example, fuse 20 may include a central, finned insulative support 64 formed of thin, lightweight synthetic resin material, with a fusible metallic strip 66 of silver or the like spirally wrapped about support 64. The support and fusible element are housed within a tubular epoxy element 68, with the ends of the latter being closed by integrally attached end caps such as cap 70 shown in FIG. 4. The opposed ends of fusible element 66 are secured to the corresponding end caps by means of conductive rivets such as rivet 73 in order to establish a current path through fuse 20. Finally, the free space within the closed element 68 is filled with arc-quenching pulverized silica sand as at 75.

Referring specifically to FIG. 4, it will be seen that source line end 79 of fuse 20 includes end cap 70 with a threadably mounted central bushing 74 therein having a threaded aperture 76 which receives stud 54 of fitting 44, the latter being attached to the end of conductor 40 situated within source-line connecting end 16. It will thus be seen that a completely insulated and encapsulated electrical connection is established between stud 52 and fuse 20 so that source current must pass through fuse 20 before reaching any internal transformer components. This encapsulation also precludes the possibility of arcing-over between the fuse source line terminal and the transformer tank wall in the event of a high magnitude fault.

Although fuse 20 can be of the full range variety, it is preferable that the fuse be constructed to actuate only upon experiencing a fault of relatively high magnitude, for example at 2,000 amps and above. This permits use of a series-related low range expulsion fuse in conjunction with the current limiting fuse. Such a combination is advantageous since during the low level faults normally experienced only the less costly and more easily replaceable expulsion fuse will operate. Furthermore, this combination enhances overall system coordination and provides a total range protection system capable of limiting low and high magnitude fault currents with substantially isoenergy dissipation within predetermined, relatively narrow limits under virtually all fault conditions experienced in practice. Finally, although one specific type of current limiting fuse has been discussed in detail herein, it is to be understood that other such fuses or current-limiting apparatus can be used to good effect in the present invention.

Several methods of manufacturing the unitary bus bar-current limiting fuse apparatus of the present invention are possible. Most preferably, current limiting fuse 20 is first manufactured and encapsulated with an insulative epoxy coating 78 which renders the fuse fully oil-submersible. The fuse is then connected to conductor 40 by threading stud 54 into the corresponding aperture of bushing 74. At this point the connected components are positioned within a complemental mold whereupon bar 12 is molded about fuse 20 and conductor 40. This presents a unitary construction which is ready for use after bar 12 is coated with conductive shielding material 19 as described. In other methods, the bus and fuse could be separately molded and removably interconnected with an insulative interface therebetween.

Figure 3:
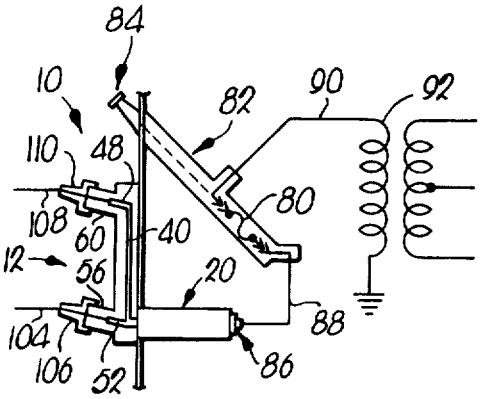
FIG. 3 is an essentially schematic representation illustrating the electrical connection of the protective apparatus of the invention on a conventional pad-mounted transformer.

As discussed, high-range fuse 20 of apparatus 10 is especially adapted to be electrically connected in series with a low-range interrupter of the expulsion fuse variety such as combination fuse and load break apparatus 38. In this respect, assembly 38 is of conventional construction and includes an expulsion fuse element 80 (FIG. 3) at the lowermost end thereof along with mechanical load break structure 82 thereabove having a handle mechanism 84 situated externally of the transformer tank 24. In use, a lineman wishing to break the current load to transformer 22 grasps handle mechanism 84 and pulls load break structure 82 out of the transformer. This procedure also permits refusing of assembly 38 as would be needed when the same actuates to clear a low-range fault. As shown in FIG. 3, the load side 86 of fuse 20 is electrically connected with fuse element 80 by means of conductor 88 so that current limiting fuse 20 and the expulsion fuse element 80 are in series. Finally, a conductor 90 is provided to electrically connect the load side of fusible element 80 and the primary 92 of transformer 22.

Figure 2:
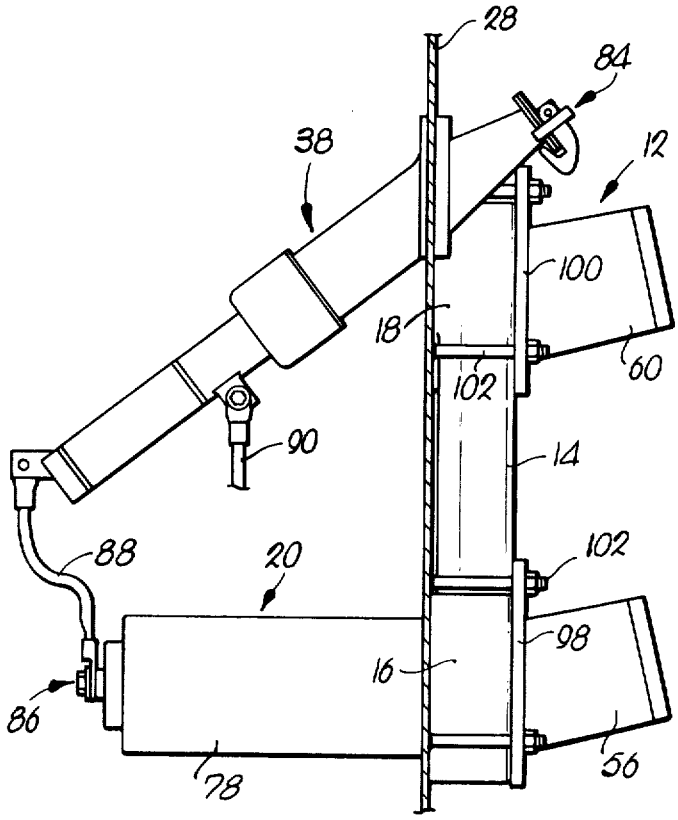
FIG. 2 is a fragmentary, side-elevational view of the bus bar-current limiting fuse construction of the present invention, shown operatively mounted on a transformer wall and electrically connected with a combination expulsion fuse-load break device.

In practice, apparatus 10 is mounted on panel 28 of transformer 22 by attaching conductor 88 between the load side of fuse 20 and assembly 38 and inserting fuse 20 through aperture 30 and positioning the rigid arcuate insulated bus bar 12 on panel 28 in order to clear parking stand clip 32. A pair of gaskets 94 and 96 are interposed between the panel 28 and the respective ends 16 and 18 of bar 12 as shown in FIG. 4. Connection to panel 28 is completed by slipping the apertured annular connection rings 98 and 100 over the corresponding bushings 56 and 60 and upstanding studs 102 provided on panel 28, and tightening the rings into place about the respective bushings 56 and 60 as best shown in FIGS. 1 and 2. In this respect it will be seen that rigid bar 12 itself serves as a reinforcing medium for panel 28 in order to rigidify the latter. At this point attachment of source-current line 104 to bushing 56 is effected by means of conventional electrical connection structure 106 so that stud 52 therein is in electrical connection with conductor 104. Similarly, load-line conductor 108 is electrically connected to stud 48 within bushing 60 by means of conventional structure

110 (see FIG. 3). This completes the electrical loop feed through bar 12 and renders protected transformer 22 ready for service. It should also be noted that line-connecting bushings 56 and 60 are strategically spaced to permit installation of the protected transformer with preexisting URD feeder lines which are positioned and dimensioned according to rigidly standardized practices. This spacing also effectively precludes the possibility of flashovers between the bushings which is an important safety feature.

During normal operation of transformer 22, electrical current entering through conductor 104 passes through stud 52, fuse 20, line 88, fusible element 80, line 90 and ultimately to primary 92. Moreover, current is passed through conductor 40 situated within internal insulated bus bar 12 and is thereafter passed through load line conductor 108 to the next series installed transformer within the system. Thus, should it be desired to isolate the next transformer in the system, it is only necessary to disconnect line 108 from stud 48, which does not of course interrupt the current load to transformer 22.

In the event of a low-range fault below about 2,000 amps for example (which occurs during at least 80 percent of all fault situations), fusible element 80 is sufficient to clear the fault without actuation of current limiting fuse 20. In these situations the expulsion fuse operates in the well-known manner and can be re-fused in the field by manipulating handle mechanism 84 and pulling the load break and fuse assembly 38 out of transformer 22 as explained. In cases where a high magnitude fault is experienced however, fuse 20 operates along with fusible element 80 in order to protect transformer 22. In these cases, fusible element 66 of fuse 20 severs or melts with consequent production of an internal arc. The latter is quickly suppressed by the surrounding silica sand in the well-known fashion in order to limit the current passing through fuse 20 to thus protect transformer 22.

In the latter connection, it is extremely important to note that the amount of internal equipment within transformer 22 is minimized, and that all of such normally energized equipment is electrically situated on the load side 86 of current limiting fuse 20. Thus, upon actuation of fuse 20, all such equipment is dead and faults cannot occur between the latter and the tank walls. This is of course to be contrasted with conventional constructions wherein an internal flexible bus is provided within the transformer tank which remains energized even after actuation of the protective fuses provided with the transformer.

It will thus be seen that the apparatus of the present invention provides a rigid, insulated, external bus while also serving to minimize the possibility of internal faults-to-ground within the transformer. In addition, when combined with a low-range interrupter as described, excellent total-range electrical protection is provided for the transformer.

Having thus described the invention, what is claimed as new and desired to be secured by Letters Patent is:

1. In combination with a transformer, external bus and current interrupting protection apparatus comprising:

a bus assembly including spaced first and second connecting means respectively adapted to be electrically connected with corresponding first source-current-carrying means and second load-current-carrying means, there being insulated conductor means electrically interconnecting said first and second connecting means;

current interrupting means secured to said bus assembly;

means electrically connecting said first connecting means with said current interrupting means such that the latter receives source current from said first currentcarrying means;

means mounting said bus assembly proximal to the external face of a tank wall of said transformer to define an external electrical feed loop through the externally mounted bus assembly; and means electrically connecting the load side of said current interrupting means with a winding of said transformer.

2. The combination as set forth in claim 1 wherein said current interrupting means comprises a current limiting fuse.

3. The combination as set forth in claim 2 wherein said current limiting fuse is operable to actuate only upon experiencing a fault of relatively high magnitude, there being a low-fault interrupter electrically interconnected between the load side of said current limiting fuse and said transformer winding.

4. The combination as set forth in claim 3 wherein said low-fault interrupter includes an expulsion fuse and load-break apparatus.

5. The combination as set forth in claim 1 wherein said first and second connecting means each comprise an annular, insulative, cup-like bushing having a central conductive stud therein.

6. The combination as set forth in claim 5 wherein said insulated conductor means comprises a curved, rod-like conductor secured at the opposed ends thereof to the conductive studs of said cup-like bushings and being surrounded by insulative synthetic resin material.

7. The combination as set forth in claim 6 wherein the exterior surfaces of said bushings and said insulative material surrounding said curved, rod-like conductor are coated with a conductive shield.

8. The combination as set forth in claim 1 wherein said current interrupting apparatus is integral with said bus assembly.

9. The combination as set forth in claim 8 wherein said current interrupting means is a current limiting fuse which extends from said bus assembly through said tank wall.

10. The combination as set forth in claim 1 wherein said means electrically connecting said first connecting means and current interrupting means is completely encapsulated within electrically insulative material.

11. Combination external bus and current interrupting apparatus, comprising:

a bus assembly including spaced first and second connecting means respectively adapted to be electrically connected with corresponding first source-current-carrying means and second load-current-carrying means, there being insulated conductor means electrically interconnecting said first and second connecting means;

current interrupting means secured to said bus assembly;

means electrically connecting said first connecting means with said current interrupting means such that the latter receives source current from said first current-carrying means, the load side of said current interrupting means being adapted for electrical connection with a transformer winding; and means for mounting said bus assembly proximal to the external face of a wall of a transformer tank with said load side of said current interrupting means being disposed for electrical connection with said winding, such that an external electrical feed loop is defined through said externally mounted bus assembly.

12. The apparatus as set forth in claim 11 wherein said current interrupting means comprises a current limiting fuse.

13. The apparatus as set forth in claim 12 wherein said current limiting fuse is operable to actuate only upon experiencing a fault of relatively high magnitude.

14. The apparatus as set forth in claim 12 wherein said current limiting fuse is configured and arranged to extend through an aperture in said tank wall when said apparatus is mounted proximal to said external face.

15. The apparatus as set forth in claim 11 wherein said first and second connecting means each comprise an annular, insulative cup-like bushing having a central conductive stud therein.

16. The apparatus as set forth in claim 15 wherein said insulated conductor means comprises a curved, rod-like conductor secured at the opposed ends thereof to the conductive studs of said cup-like bushings and being surrounded by insulative synthetic resin material.

17. The apparatus as set forth in claim 16 wherein the exterior surfaces of said bushings and said insulative material surrounding said curved, rod-like conductor are coated with a conductive shield.

18. The apparatus as set forth in claim 11 wherein said current interrupting apparatus is integral with said bus assembly.

19. The apparatus as set forth in claim 11 wherein said means electrically connecting said first connecting means and current interrupting means is completely encapsulated within electrically insulative material.

* * * * *